US008167147B2

(12) United States Patent
Frankel et al.

(10) Patent No.: US 8,167,147 B2
(45) Date of Patent: May 1, 2012

(54) DISH DRAINER

(75) Inventors: Seth Frankel, Los Angeles, CA (US); Joy Burns, Redondo Beach, CA (US); Sarah Rosenbach, Oakland, CA (US); Randall Lewis, Simi Valley, CA (US); James Talmage Davis, II, Springville, UT (US); Colin Greenidge, Thousand Oaks, CA (US); Brad Cracchiola, Agoura Hills, CA (US); Soren Ingomar Petersen, South Pasadena, CA (US)

(73) Assignee: Rubbermaid Incorporated, Huntersville, NC (US)

( * ) Notice: Subject to any disclaimer, the term of this patent is extended or adjusted under 35 U.S.C. 154(b) by 763 days.

(21) Appl. No.: 11/754,222

(22) Filed: May 25, 2007

(65) Prior Publication Data

US 2008/0135505 A1 Jun. 12, 2008

Related U.S. Application Data

(60) Provisional application No. 60/808,417, filed on May 25, 2006.

(51) Int. Cl.
*A47G 19/08* (2006.01)

(52) U.S. Cl. ..... 211/41.3

(58) Field of Classification Search ..... 211/41.3, 211/41.4, 41.5, 41.18, 41.6, 133.5, 181.1, 211/41.8, 41.9; D32/55; 134/108; 220/488
See application file for complete search history.

(56) References Cited

U.S. PATENT DOCUMENTS 463,056 A 11/1891 Jayne
2,655,267 A 10/1953 Planeta
2,708,037 A * 5/1955 Planeta ..... 211/74
3,027,041 A 3/1962 Stansbury et al.
3,442,395 A 5/1969 Taylor
4,726,475 A * 2/1988 Ferenzi ..... 211/41.5
4,927,033 A * 5/1990 Patera et al. ..... 211/41.9
5,158,184 A 10/1992 Craft et al.
5,249,590 A * 10/1993 Jacobus et al. ..... 134/135
D353,922 S 12/1994 Drake
5,385,261 A 1/1995 Lippisch et al.
5,588,539 A 12/1996 Belden et al.
D398,725 S * 9/1998 Merkel ..... D32/55
6,109,455 A * 8/2000 Schroeder ..... 211/41.9
6,357,605 B1 3/2002 Martorella
6,364,130 B2 4/2002 Wright
6,502,704 B2 1/2003 Martorella et al.
6,763,954 B1 7/2004 Travers et al.
D518,615 S * 4/2006 Yang et al. ..... D32/55
D518,936 S * 4/2006 Yang et al. ..... D32/55
7,228,975 B2 * 6/2007 Yang et al. ..... 211/41.4
7,281,469 B1 * 10/2007 Barbour et al. ..... 99/426
7,455,184 B2 * 11/2008 Yang et al. ..... 211/41.4
2004/0238464 A1 12/2004 Cheung
2005/0150528 A1 * 7/2005 Kim ..... 134/108
2005/0167374 A1 * 8/2005 Yang et al. ..... 211/41.18
2006/0169652 A1 * 8/2006 Yang et al. ..... 211/41.3
(Continued)

*Primary Examiner* — Sarah Purol

(74) *Attorney, Agent, or Firm* — Lempia Summerfield Katz LLC

(57) ABSTRACT

A dish drainer assembly has a basket with a bottom and a side wall extending up from a perimeter of the bottom. The side wall terminates at a top edge. A cut out is formed in a part of the side wall and has an upper edge that is lower than the top edge of the remainder of the side wall. A drying accessory has a plurality of fingers spaced apart from one another and is configured to removably attach to the basket in a first position and a second position different from the first. The fingers are oriented differently in each of the first and second positions.

22 Claims, 6 Drawing Sheets

U.S. PATENT DOCUMENTS

2006/0237379 A1* 10/2006 Yang et al. ..... 211/41.4
2007/0144984 A1* 6/2007 Sullivan et al. ..... 211/41.3
2008/0029465 A1* 2/2008 Yang et al. ..... 211/41.5
2008/0116155 A1* 5/2008 Yang et al. ..... 211/41.3
2008/0135505 A1* 6/2008 Frankel et al. ..... 211/41.4
2008/0185352 A1* 8/2008 O'Hara ..... 211/13.1

* cited by examiner

DISH DRAINER

RELATED APPLICATION DATA

This patent is related to and claims priority benefit of U.S. provisional patent application Ser. No. 60/808,417, which was filed on May 25, 2006, which was entitled "Dish Drainer," and the entirety of which is incorporated herein by reference.

BACKGROUND OF THE INVENTION

1. Field of the Disclosure

The present disclosure is generally directed to dish drainers, and more particularly to a dish drainer assembly that can be reconfigured in several ways to accommodate different dish drying needs.

2. Description of Related Art

Dish drainers are known in the art that address specific dish drying problems independently. For example, some dish drainers are configured at least having one portion to specifically accommodate inverted drinking vessels for drying glasses, cups, and the like. Cup holders are typically arranged to dry the cups on the interior of the dish drainer or basket. In another example, some dish drainers or drying racks include an area within the rack that is open for drying large items such as cookie sheets, cutting boards, serving plates, and the like. This area is less than efficient if used for drying smaller items, silverware, cutlery, and the like. Also, the side walls of the rack can get in the way of some large dishes, pots, and the like.

In a further example, dish drainers or racks are known that provide a silverware or cutlery receptacle for drying these items in a vertical orientation. A typical dish rack provides the receptacle in a configuration so that it must be used within the interior of the rack.

There are also drying systems known in the art that provide an area that is elevated for drying delicate or sharp objects away from other objects. This area in such a device is positioned so that a user can readily access these items before reaching for other items in the device to avoid injuring themselves on sharp objects and/or to avoid bumping the delicate items while being removed from the device. This can preserve the delicate items and avoid injury to the dish dryer. Such a platform is typically provided as a fixed or non-removable feature.

As noted above, these different dish drying problems have been addressed separately in prior art dish drainers, drying racks, and the like. In other words, some of these known devices address or attempt to solve only one of these problems at a time. There are a few dish drying racks or drainers that attempt to address two or more of these problems. However, they do so by incorporating two or more entirely independent and separate features in the dish drainer to accomplish these solutions. The independent features often may interfere with one another when used together and/or further utilize valuable drying space within the device when only one feature is needed for drying.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The dish drainer assembly disclosed and described herein solves or improves upon one or more of the above-noted and other problems and disadvantages with prior known dish drainers and racks. The disclosed dish drainer assembly includes a loft or drying accessory that can be removed entirely from the dish drainer assembly or can be positioned in at least three different orientations on the drainer to perform alternate drying functions. Thus, the disclosed dish drainer assembly can be arranged in at least four different configurations to accommodate a number of dish drying needs. The disclosed dish drainer assembly includes a basket in combination with the drying accessory. The basket and the accessory are reconfigurable in combination with one another to achieve the different dish drainer configurations. In one disclosed configuration, the dish drainer basket is suitable for use to dry a number of very large objects without use of the accessory. In another configuration, the disclosed dish drainer assembly is suitable for drying delicate and/or sharp objects on an elevated surface of the drying accessory positioned above the bottom of the basket. In still another configuration, the dish drainer assembly is suitable for drying a plurality of cups, drinking vessels, or other objects suspended on the drying accessory. In yet another configuration, the disclosed dish drainer assembly is suitable for drying objects on an elevated surface of the drying accessory positioned outboard of the basket such that the surface does not interfere with the interior drying space of the basket. The disclosed dish drainer assembly can be configured to include an ordinary utensil holder to dry utensils in the holder connected to the basket.

Figure 1:
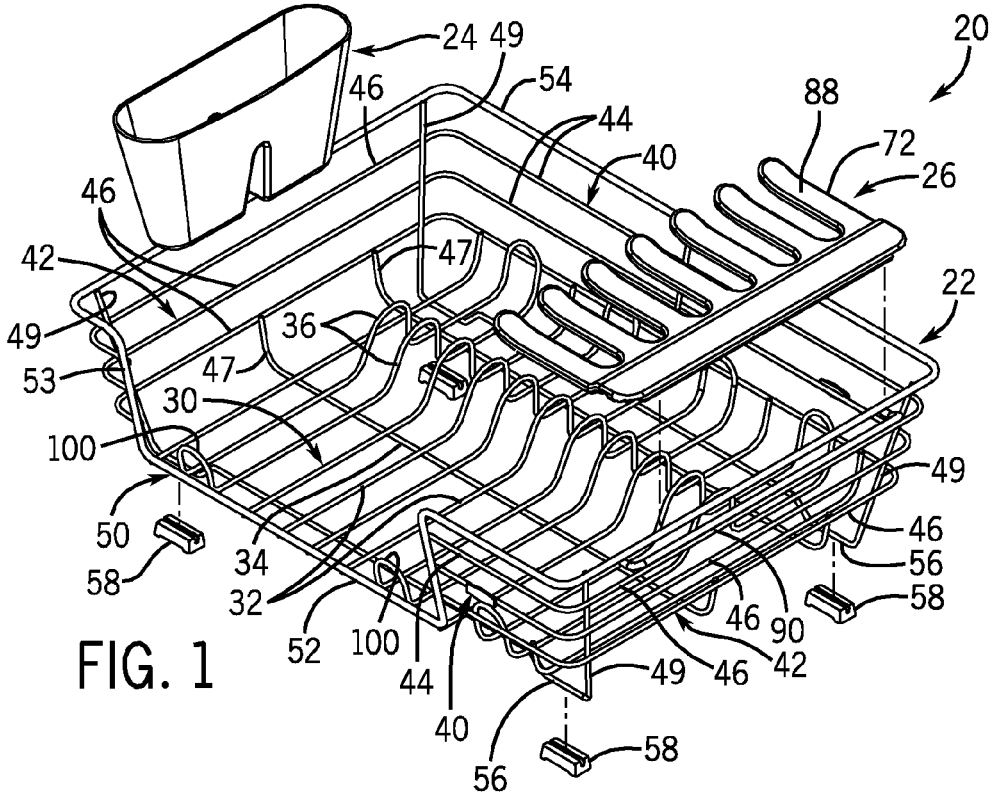
FIG. 1 is an exploded perspective view of one example of a dish drainer assembly constructed in accordance with the teachings of the present invention.

Turning now to the drawings, FIG. 1 is an exploded view of a dish drainer assembly 20 constructed in accordance with the teachings of the present invention. In this example, the dish drainer assembly 20 generally includes a dish drying rack or basket 22, a conventional utensil holder or receptacle 24, and a loft or drying accessory 26. In the disclosed example, the basket or rack 20 is a wire form structure including metal wires that can either be exposed or coated with a layer of a softer, durable material to both prevent corrosion to the wires and damage to dishes placed in the basket, as is known in the art. The wires can be welded together to form the basket 22 in this example. The coating can be applied, if desired, to the assembled wire structure by any suitable means such as dip coating or the like. In another example, the basket 20 can be configured from other materials, such as injection molded plastic or the like.

In this example, the basket 20 has a bottom 30 formed of a plurality of transverse and generally parallel wires 32. The transverse wires are supported by several longitudinal wires 34 positioned underneath and perpendicular to the transverse wires in this example. As will be evident to those having ordinary skill in the art, the particular arrangement, configuration, orientation, and number of wires or other dish support elements can vary and yet fall within the spirit and scope of the present invention. Each of the transverse wires 32 in this example is bent creating an upstanding curved portion 36 centrally within the bottom 30. The curved portions 36 are aligned longitudinally with one another as is known in the art to create dish plate slots 38 between the curved portions. Plates or other disc-like dishes, pots, lids, and the like can be positioned between any pair of the upstanding portions 36 for drying the dishes in a generally vertical orientation.

The basket 22 in this example also includes a side wall extending upward from a perimeter of the bottom 30. The side wall has a pair of opposed sides 40 and a pair of opposed ends 42, each also formed of a plurality of horizontal wire segments 44 and 46, respectively. In the disclosed example, one or more of the longitudinal wires 34 on the bottom 30 have a vertical wire section 47 that extends beyond the end of the bottom and that is bent upward. The wire sections 47 support the wire segments 46 of the ends 42. Similarly, one or more of the transverse wires 32 has a vertical wire section 48 that extends beyond the side of the bottom 30 and that is bent upward to support the wire segments 44 of the sides 40. As shown in this example, the outer most two of the longitudinal wires 34 have sections 49 that are bent upward at the corners of the basket 22. In this example, the wire segments 44 and 46 each are essentially part of continuous perimeter side wall wires that surround the basket. Portions of each perimeter side wall wire form the wire segments 44 on the sides and portions form the wire segments 46 on the ends. The perimeter side wall wires are vertically spaced apart as is shown.

In the disclosed example, the basket 22 has a cut out 50 on a portion of one of the sides 40. The cut out 50 has a width that extends a substantial portion of the length of the side wall and has a height that extends down a substantial portion of the height of the side wall. An upper edge wire 52 defines the lower boundary of the cut out 50. The ends of the edge wire 52 bend upward to create side wires 53 that form the opposite sides of the cut out 50. The side wires 53 continue upward and are bent horizontally in opposite directions to form a top most wire 54. The wire 54 circumscribes the remainder of the basket 22 and defines the top edge of the side wall.

The various wires of the basket 22 are arranged in the disclosed example in one of many possible alternate configurations. In the disclosed example, the cut out 50 forms one aspect of the disclosed invention in conjunction with the drying accessory 26. The remaining parts of the basket 22 described above can vary considerably and yet fall within the spirit and scope of the present invention. Further, the location and shape of the cut out 50, as well as its height and width, can vary from that disclosed and described herein and yet function as intended.

As shown in FIG. 1, the corner wires 49 in this example are bent near their bottom ends to create four flat feet 56, one at each basket corner, on the bottom 30 of the basket. Rubber pads 58 or the like can be adhered, clipped, snapped on, or otherwise attached to the feet 56. The pads 58 can be fabricated from a no-slip material to provide stability for the dish drainer assembly 20 and to help protect the counter top surface during use, if desired.

The disclosed dish drainer assembly 20, in one configuration represented by FIG. 1, can employ only the basket 22 for drying. Both the drying accessory 26 and the utensil holder 24 can be detached from the basket and not be used in this configuration. Thus, in this configuration, the dish drainer assembly 20 can be utilized with the cut out 50 left open. Very large pots and other large or lengthy dish items can be dried in the basket 22 and a portion of these items can extend through the cut out 50 for drying. With the open, unencumbered cut out 50 in the side 40 of the basket 22, the size of a dish or pot that can be positioned within the basket for drying can vary and be substantially larger than the basket 22.

The utensil holder 24 in the disclosed example is a conventional receptacle with a bottom 60 and an upstanding perimeter side wall 62. The bottom can be perforated and include a plurality of openings 64. A hook 66 is provided extending outward from a top edge of the side wall 62 and can be hooked onto the top wire 54 of the basket 22. The utensil holder 24 shown and described herein is known in the art and can be optionally employed to further customize the assembly 20 for drying.

Figures 2, 3:
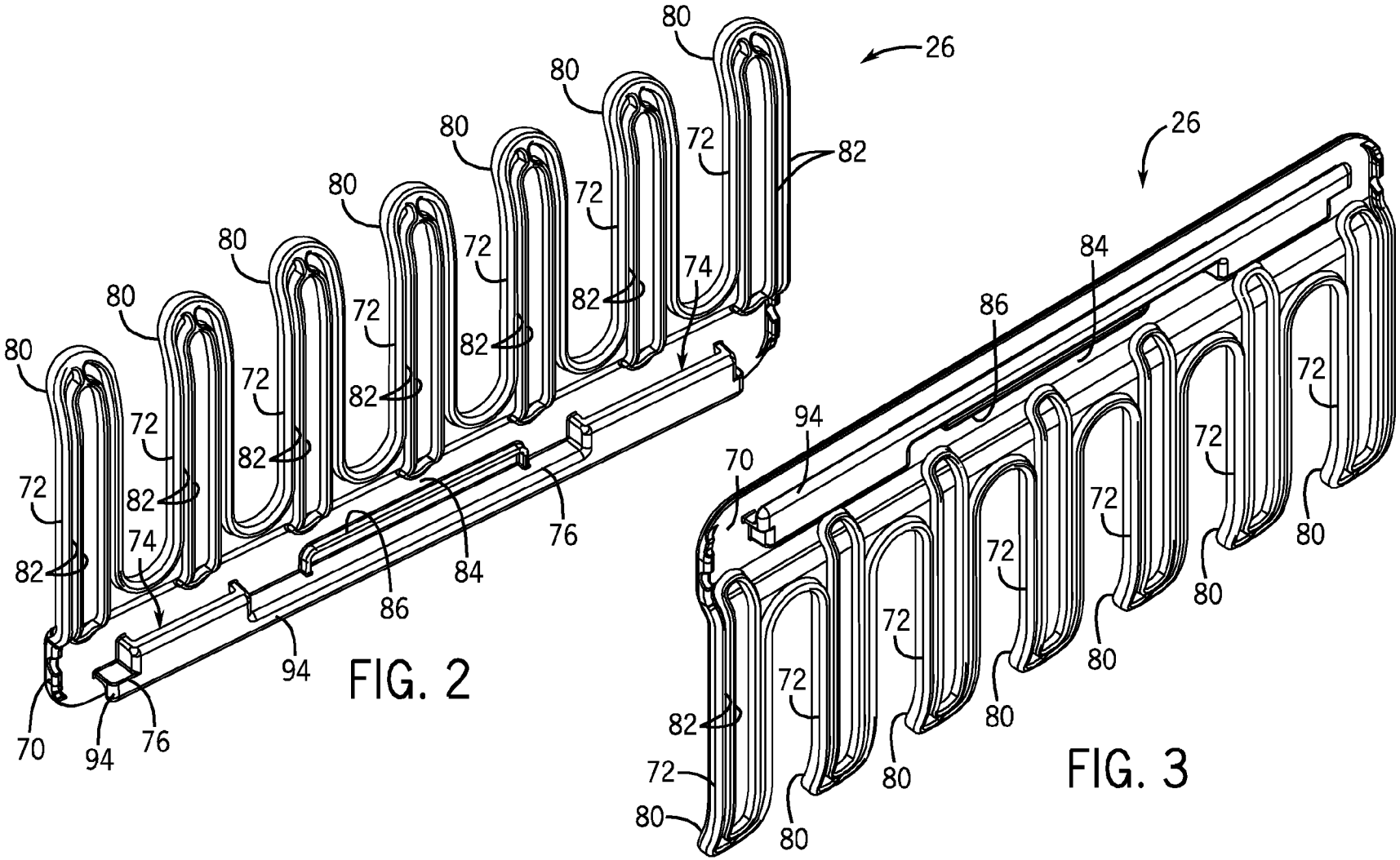
FIG. 2 is a top and rear perspective view of the loft drying accessory for the dish drainer assembly shown in FIG. 1
FIG. 3 is a bottom and rear perspective view of the loft drying accessory shown in FIG. 2.
Figure 5:
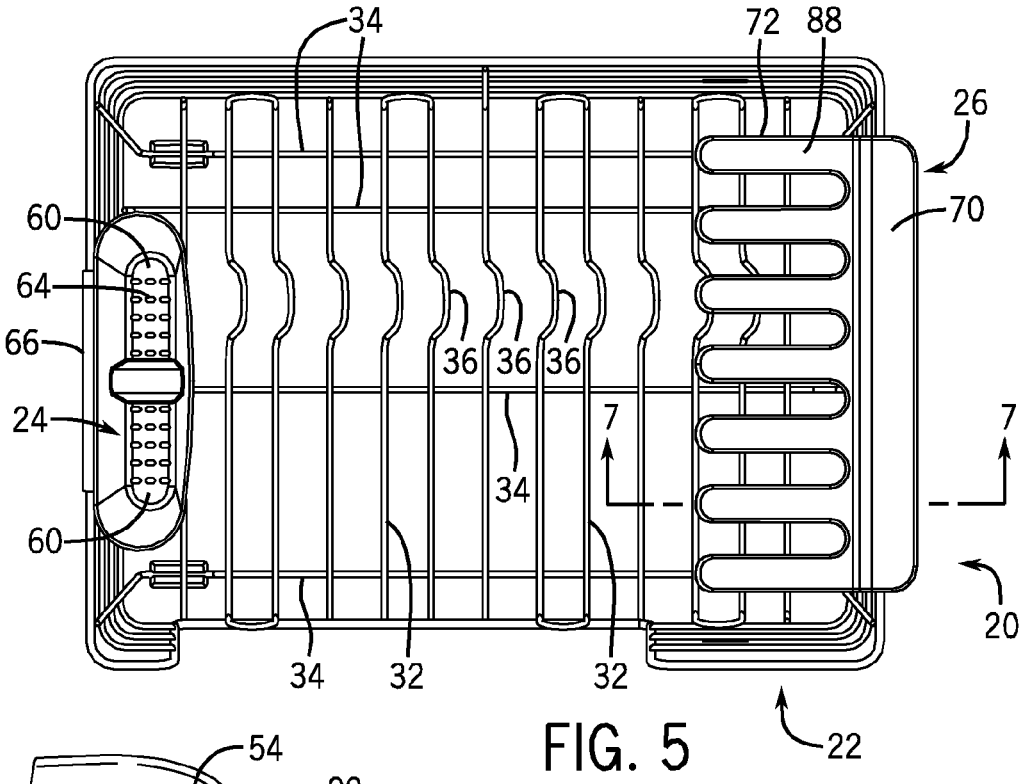
FIG. 5 is a top view of the dish drainer assembly shown in FIG. 4.
Figure 6:
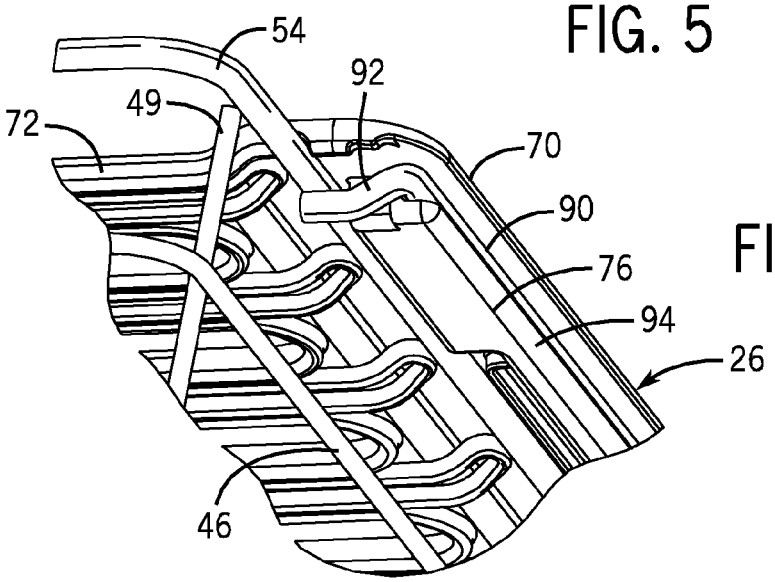
FIG. 6 is a close up perspective view of part of the loft drying accessory of FIG. 5 and viewed from underneath the accessory.
Figure 7:
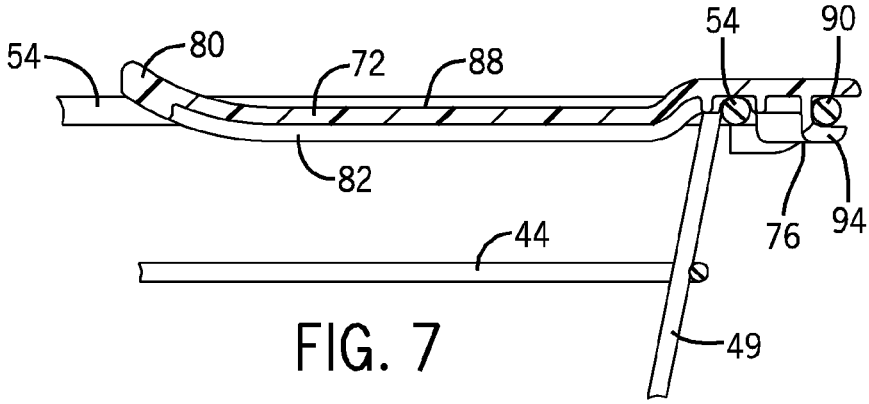
FIG. 7 is a cross-section taken along lines VII-VII of the dish drainer assembly shown in FIG. 5.
Figure 8:
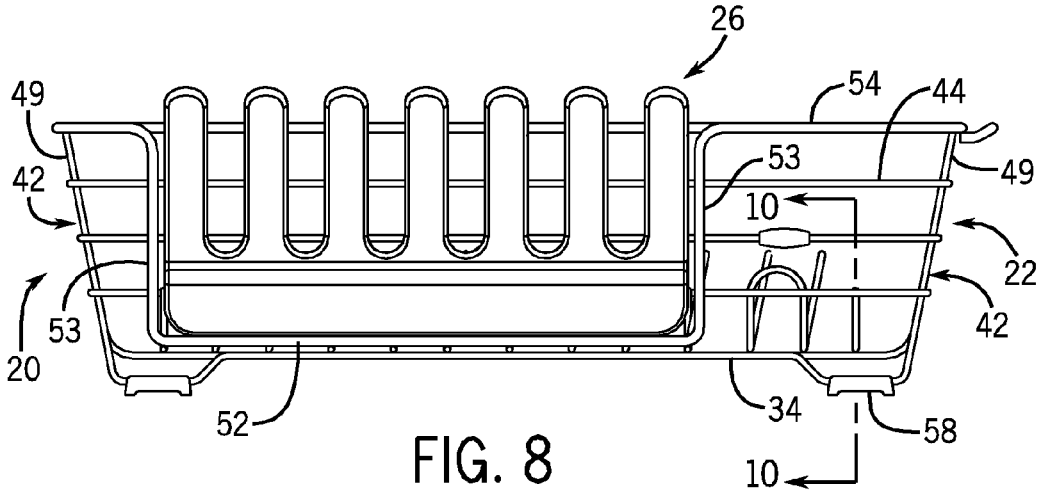
FIG. 8 is a side view of the dish drainer assembly shown in FIG. 1, but assembled in another alternative dish drying configuration.
Figure 9:
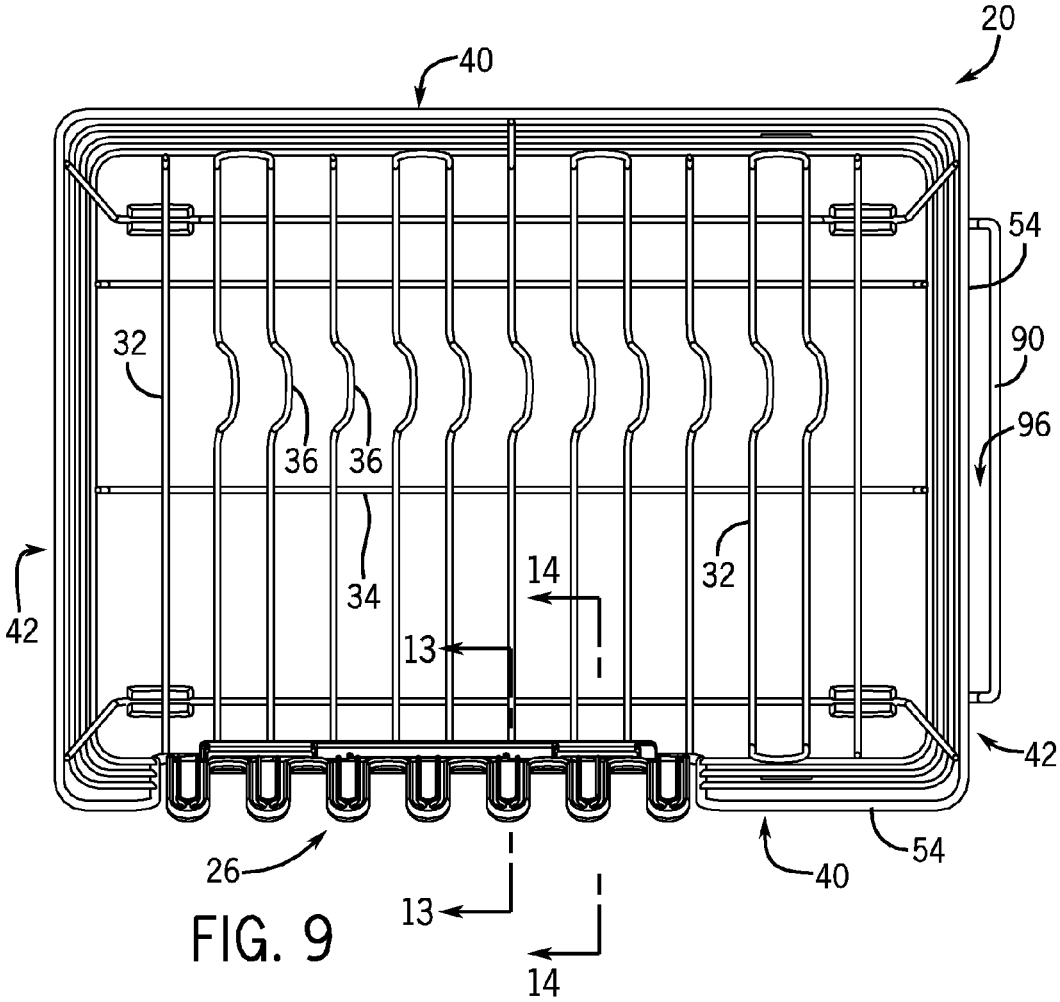
FIG. 9 is a top view of the dish drainer assembly shown in FIG. 8.
Figure 11:
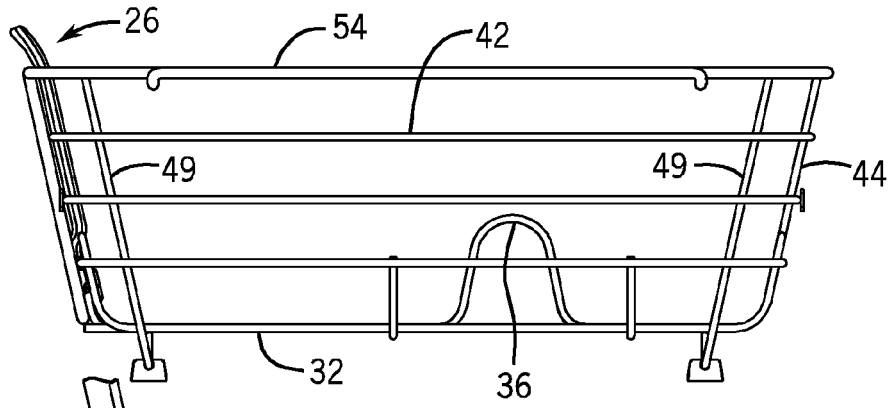
FIG. 11 is an end view of the dish drainer assembly shown in FIG. 8.
Figure 10:
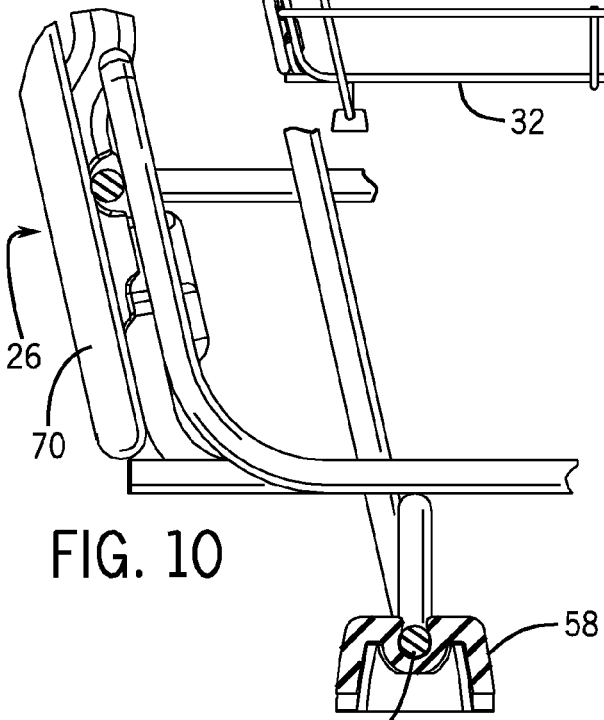
FIG. 10 is a cross-section taken along line X-X of the dish drainer assembly shown in FIG. 9.

The drying accessory or loft 26 in the disclosed example is configured to be attached to the basket 22 in more than one position and orientation. As shown in FIGS. 1-3, the drying accessory 26 generally includes an elongate tie or support 70. A plurality of spaced apart elongate fingers 72 project perpendicularly from an edge of the support 70 and are tied to one another by the support. One side of the support 70 is a back side or underside and includes a pair of laterally spaced apart receptacles or slots 74. The slots are parallel to the support 70 in this example and are open on the top and bottom and bounded within a plastic protrusion 75 spaced from the support 70. The one side of the support 70 also includes an elongate hook 76 that opens facing downward away from the fingers as illustrated in FIGS. 2 and 3. The open hook 76 also projects rearward from the one side of the base support 70 and extends longitudinally along the support. As shown in FIGS. 2 and 3, the receptacles or slots 74 are essentially formed through portions of a closed top 78 on opposite ends of the hook 76.

In the disclosed example, the drying accessory 26 is formed of a molded plastic material and the fingers 72 are integrally molded with and extend from the edge of the base 70. As will be evident to those having ordinary skill in the art, the loft can be configured from other materials using other processes and yet perform as intended. In one alternative example, the drying accessory can also be formed of a welded wire configuration similar to the disclosed basket 22.

In the disclosed example, the fingers 72 each include a distal end 80 that is upturned, angled, or bent in a direction opposite to the one side or back side of the support 70. The back or rear side of each of the fingers 72 includes a plurality of ribs 82 extending longitudinally along the finger. These ribs add strength and stability to the finger to assist in supporting heavy glasses, cups, drinking vessels or other objects during drying as described below. These ribs 82 also add strength and stability to the fingers when lying in a cantilevered, horizontal orientation for supporting articles for drying as described below.

An elongate flat surface 84 is provided on the back side of the support 70. The flat surface 84 is positioned generally between the ends of the ribs 82 on the fingers 72 and the top edges 85 of the protrusions that define the receptacles 74. A bearing or positioning rib 86 extends laterally across the back side of the support 70. The rib 86 is spaced from the top 78 of the hook 76 between the receptacles 74 and is positioned to align with the edges 85 of the receptacles that face the surface 84. The opposite surfaces of the fingers 72 are generally flat in the disclosed example and define support surfaces 88 on the fingers. The purpose of the surfaces 88 is also described below. The distal ends 80 of the fingers 72 are upturned in a direction relative to these surfaces 88.

As shown in FIG. 1 the basket 22 in this example includes a support wire 90 positioned spaced outward from a portion of the top wire 54 on one end 42 of the basket. Bent ends 92 of the wire 90 connect the wire 90 to the top wire 54. In this example, the support wire 90 and top wire 54 lie generally in the same plane.

The drying accessory or loft 26 can be attached to the basket 22 in one position resulting in the drainer assembly 20 being useful in a second configuration. As shown in FIGS. 4-7, the loft 26 can be attached to the basket 22 in a first position creating an elevated horizontal drying surface over the bottom 30 in the basket 22. The elevated drying surface is created by the upward facing finger surfaces 88. The drying surface can be selectively utilized by rearranging the loft 26 to this first position. In the disclosed example, the top wire 54 acts as a bearing surface and bears against the flat surface 84 on the back side of the loft 26. The hook 76 is sized to fit within a space or gap 94 between the support wire 90 and the top wire 54. As shown in the cross-section of FIG. 7, a free leg 96 of the hook 76 underlies the support wire 90, which fits within a gap between the leg and the support 70. The hook 76 keeps the loft 26 from rotating up and off the support wire 90. The top wire 54 bears against the underside surface 84 of the loft to retain the fingers 72 in the cantilevered position shown in FIG. 4. The ribs 82 provide strength to the fingers 72 to support objects for drying. The upturned tips 80 on the fingers 72 can assist in keeping objects from sliding off the ends of the fingers during use.

Figure 4:
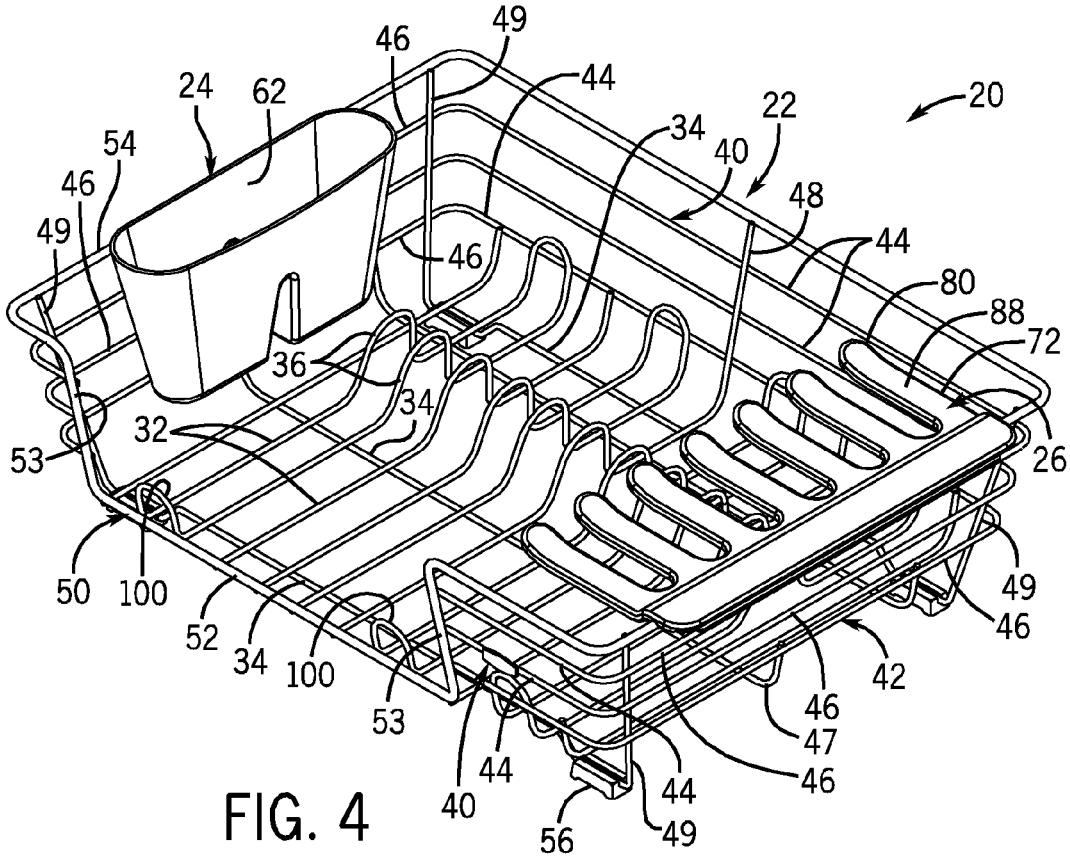
FIG. 4 is a perspective view of the dish drainer assembly shown in FIG. 1 and assembled in one alternative dish drying configuration.

As shown in FIGS. 8-14, the loft 26 can be attached to the basket 22 in a second position, resulting in a third configuration for the assembly 20. In this second position, the loft 26 is placed within the cut out 50 between the side wires 53. As shown in FIGS. 1 and 4, a pair of upstanding tabs 100 extends upward above the top or upper edge wire 52 within the cut out 50. In the disclosed example, these two tabs 100 are formed as a wire loop interconnecting the ends of two adjacent ones of the transverse wires 32. The loop portion is formed as a continuation of two of the adjacent wires integrally connected with one another and standing above the upper edge wire 52 in the cut out 50. The loop portion creates the tab 100 in this example.

Figure 12:
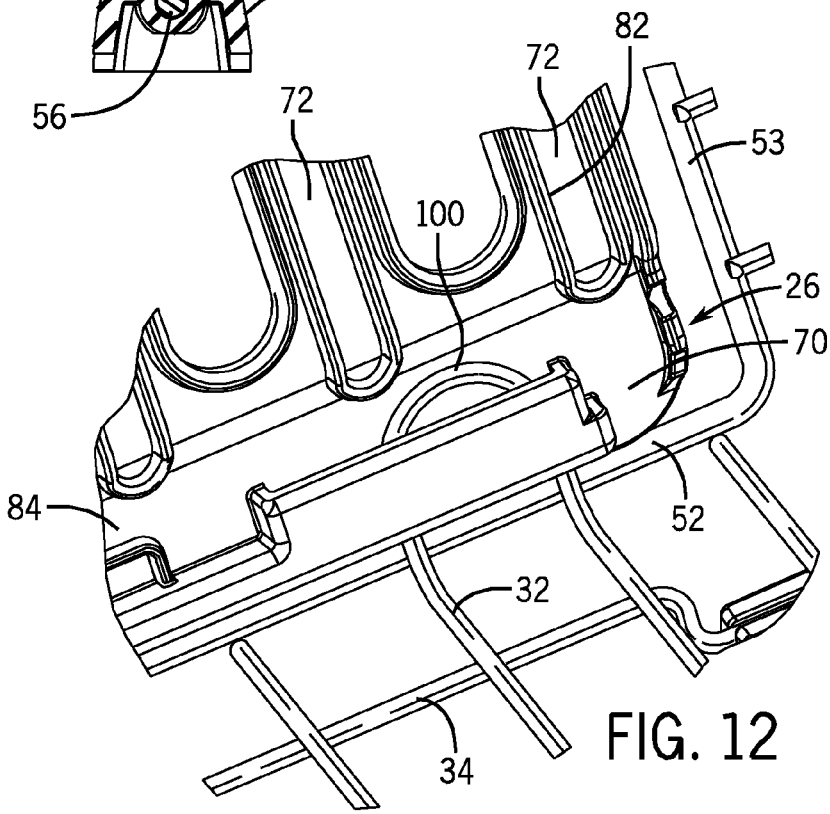
FIG. 12 is a close up perspective view of part of the loft drying accessory of FIG. 8 and viewed from within the interior of the basket.
Figure 13:
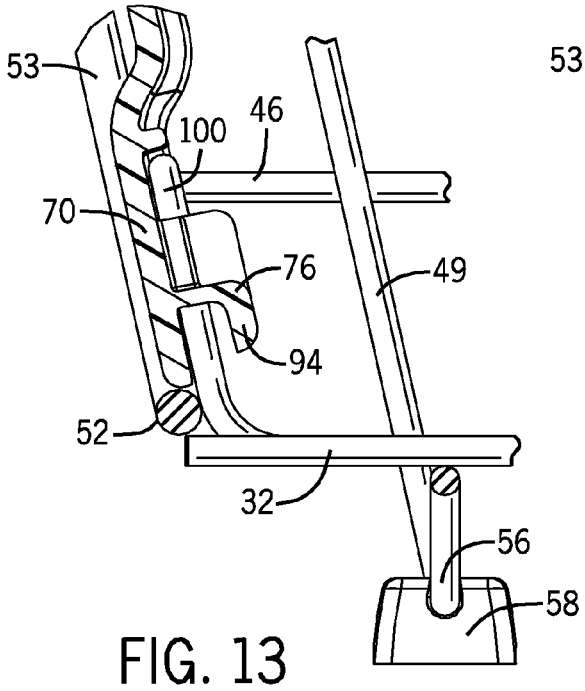
FIG. 13 is a cross-section taken along lines XIII-XIII of the dish drainer assembly shown in FIG. 1.
Figure 14:
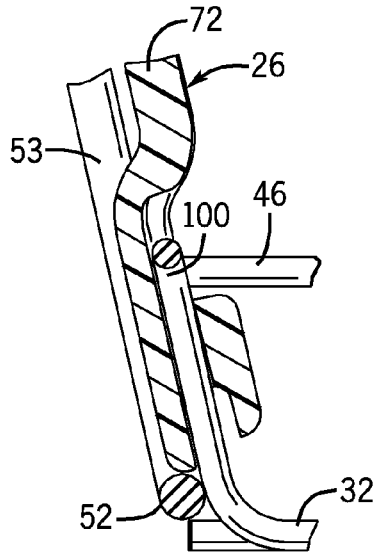
FIG. 14 is a cross-section taken along lines XIV-XIV of the dish drainer assembly shown in FIG. 19.

To attach the loft 26 to the basket 22 in this second position, the loft is simply positioned over the tabs 100 with the receptacles 74 lying above the tabs. The receptacles 74 can be sized to receive the tabs 100 and the loft 26 can be dropped down onto the tabs as shown in FIGS. 12-14. The tabs 100 are captured within the receptacles 74 to retain the loft 26 in its generally vertical or upward extending orientation in this position. Thus, the loft 26 can be prevented from rotating inward or outward from the cut out 50. The downward or elevational positioning of the loft 26 in this second position is controlled by the top of the tab 100 contacting a finger rib 82 and/or the bottom edge of the support 70 resting on the upper edge wire 52 of the cut out 50. One or more of these components can be shaped and positioned to provide a positive stop if desired that also aids in holding the loft or drying accessory in place.

As will be evident to those having ordinary skill in the art, the attachment mechanisms for holding and supporting the drying accessory of loft in place in the first and second positions can each vary and yet fall within the spirit and scope of the present invention. In one example, the mechanism for each position can be the same instead of employing two different mechanisms as in the disclosed example. A pair of laterally extending wings can project from the loft and lie against the side wall to assist in supporting the loft in position, particularly in the second cup drying position.

In the disclosed example, each of the fingers 72 is spaced apart from the other fingers and arranged generally parallel to the other fingers. Each finger also includes the surface 88 on the top or front side of the loft 26. The hook 76 and the receptacles 74 are on the opposite or back side of the loft in the disclosed example. The surface 88 of each finger 72 lies generally in the same plane as the surface of the other fingers in this example. Thus, with the loft in the first position, these surfaces 88 combine to form the elevated drying surface for sharp objects, delicate washed items, and the like. Also in the disclosed example, the fingers 72 are oriented such that they lie generally extending upward when the loft is attached to the basket in the second position. The spacing of the fingers is such that each can be received within a drinking vessel for drying. In this example, the fingers are generally aligned with a plane of the side wall in the second position.

As will be evident to those having ordinary skill in the art, the fingers can be arranged to lie in different planes, to be non-parallel with one another, or both, as desired. Additionally, the loft can be configured to position the fingers further outward from the plane of the side wall so that cups or other objects can be dried resting further outside of the basket interior space, leaving more space for drying. Additionally, the fingers need not lie generally in the same plane as the side wall. Instead, the fingers can be oriented at an angle in the second position that is non-parallel to the plane of the side wall. The configuration, shape, length, and the like of the fingers can also vary from that shown herein, as can that of the wire 90, the tabs 100, and the support 70.

In the example shown in FIGS. 4-7, the loft 26 is oriented and attached to the basket 22 such that the fingers 72 lie generally parallel to the bottom 30 of the basket and extend inward toward the interior and other end of the basket. Thus, in this orientation, the fingers 72 overlie the bottom 30. In an alternative example, though not shown in the drawings, the loft 26 can be reversed and attached to the basket with the fingers extending outside of the basket's side wall. In such an arrangement, the underside or back side of the loft 26 will bear against the support wire 90 and the hook 76 would engage the top wire 54 in a reverse orientation to that shown in FIG. 7. The support wire 90 must fit around the outer edges of the elongate hook 76 in such an example. Thus, the loft 26 could be attached to the basket in two different and alternate orientations. In the alternate (not shown) orientation, the loft 26 can still provide a horizontal drying surface, but does not interfere with the basket interior drying space. This reverse loft orientation creates a third position for mounting the loft or drying accessory 26 disclosed herein. Thus, the assembly 20 can be reconfigured to a fourth configuration for drying.

Figure 15:
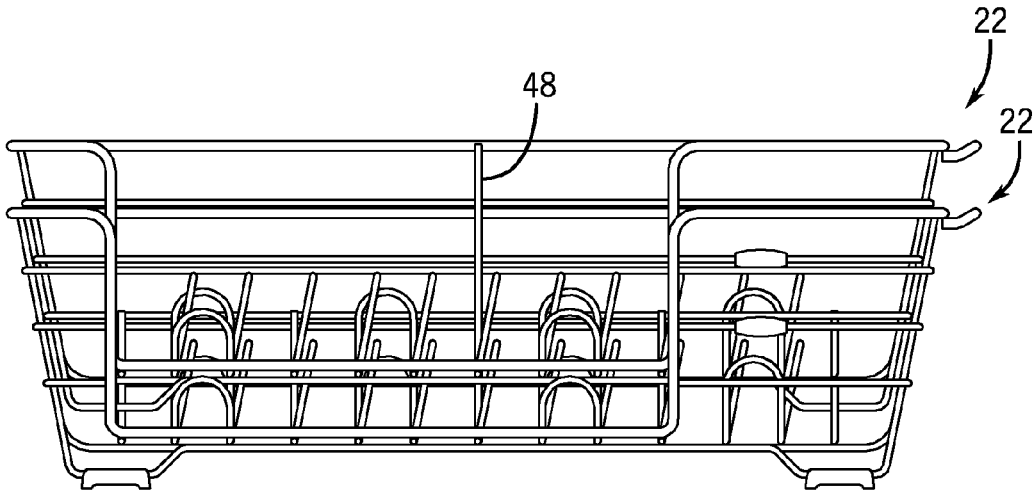
FIG. 15 is a side view of a stack of two dish drainer baskets substantially identical to the basket of the dish drainer assembly shown in FIG. 1.

As shown in FIG. 15, the basket can be configured with a drafted side wall as shown so that multiple baskets 22 can be stacked in a manner providing a more efficient shipping and store shelf stacking cube. The loft 26 and utensil holder 24, if provided, can also be sized so that they can lie within the baskets for shipping. Alternatively, the utensil holders can be configured to stack with one another and be stored and/or shipped separate from the baskets. The lofts can be thin enough in the disclosed embodiment such that they can rest on the bottom 30 of their own respective basket 22 when stacked as shown in FIG. 15, even though the lofts are not illustrated in the figure.

Although certain dish drainer features and components have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A dish drainer assembly comprising:

a basket having a bottom and a side wall extending up from a perimeter of the bottom, the side wall terminating at a top edge;

a cut out in a part of the side wall and having an upper edge that is lower than the top edge of the side wall; and a drying accessory having a plurality of fingers having distal ends spaced apart from one another such that each finger can be received within a drinking vessel, the drying accessory configured to removably attach to the basket in a first position at a first attachment location within the cut out and in a second position different from the first at a second attachment location not within the cut out, the fingers being oriented generally vertically in the first position and generally horizontally in the second position.

2. A dish drainer assembly according to claim 1, wherein the drying accessory is positioned within the cut out with the fingers extending generally upward in the first position.

3. A dish drainer assembly according to claim 1, wherein the drying accessory is attached to a portion of the side wall with the fingers oriented generally horizontally in the second position.

4. A dish drainer assembly according to claim 3, wherein the drying accessory is positioned within the cut out with the fingers extending generally upward in the first position.

5. A dish drainer assembly according to claim 1, wherein the basket is a wire form basket.

6. A dish drainer assembly according to claim 1, wherein the drying accessory is a plastic molded component with an elongate connector integrally molded with the plurality of fingers interconnecting one end of each of the fingers.

7. A dish drainer assembly according to claim 1, wherein the fingers are parallel to one another.

8. A dish drainer assembly according to claim 1, wherein each finger has a generally flat surface on one side that lies in generally the same plane with the flat surfaces of the other fingers.

9. A dish drainer assembly according to claim 8, wherein the distal end of one or more of the fingers has a surface that is bent out of plane relative to the respective flat surface.

10. A dish drainer assembly according to claim 1, wherein the drying accessory is attached to a portion of the side wall in the second position such that the fingers are oriented generally parallel with a plane of the bottom surface of the basket.

11. A dish drainer assembly according to claim 1, wherein the drying accessory is positioned within the cut out in the first position such that the fingers extend generally upward and generally parallel with the adjacent portions of the side wall.

12. A dish drainer assembly according to claim 1, wherein the drying accessory further comprises an elongate connector extending between and connected to one end of each of the fingers.

13. A dish drainer assembly according to claim 12, further comprising:

one or more tabs projecting upward into the cut out from the upper edge; and one or more receptacles along an edge of the elongate connector, each receptacle configured to accept a respective tab in the cut out to attach the drying accessory within the cut out in the first position with the fingers extending generally upward.

14. A dish drainer assembly according to claim 12, further comprising:

a cantilevered support positioned outward from a portion of the top edge of the side wall; and one or more projections on the elongate connector, the one or more projections configured to engage the cantilevered support to attach the drying accessory to the side wall in the second position with the fingers oriented generally horizontally.

15. A dish drainer assembly according to claim 14, wherein the basket is a wire form basket with a top wire extending around the basket at the top edge of the side wall, wherein the cantilevered support is a support wire positioned spaced outward from the top wire, and wherein the one or more projections are one or more hooks configured to hook under the support wire.

16. A dish drainer assembly according to claim 1, wherein the drying accessory can be attached to the side wall at one end of the basket with the fingers oriented generally horizontally and extending toward the other end of the basket in the second position, and wherein the drying accessory can be attached to the side wall with the fingers oriented generally horizontally and extending outward away from the basket in a third position.

17. A dish drainer assembly according to claim 1, further comprising:

a utensil holder with a perforated bottom, and upstanding side wall, and a hook on a top edge of the side wall connectable to the top edge of the basket.

18. A dish drainer assembly according to claim 1, wherein the fingers are generally parallel to one another and are each oriented generally upright and configured to support an inverted drinking vessel in the first position.

19. A dish drainer assembly according to claim 1, wherein the fingers are generally parallel to one another and are oriented generally horizontally forming an elevated drying surface above an elevation of the bottom of the basket in the second position.

20. A dish drainer assembly according to claim 19, wherein the fingers are each oriented generally upright and configured to support an inverted drinking vessel in the first position.

21. A dish drainer assembly according to claim 1, wherein the drying accessory is configured to removably attach to the basket in a third different from the first and second positions.

22. A dish drainer assembly according to claim 21, wherein the dish drainer assembly can be used in four different configurations for drying including a first configuration utilizing only the basket without the drying accessory, a second configuration utilizing the basket and the drying accessory in the first position, a third configuration utilizing the basket and the drying accessory in the second position, and a fourth configuration utilizing the basket and the drying accessory in the third position.

* * * * *